US007428831B2

(12) United States Patent
Cho et al.

(10) Patent No.: US 7,428,831 B2
(45) Date of Patent: Sep. 30, 2008

(54) DETERGENT CONTAINER OF WASHING MACHINE

(75) Inventors: Han Ki Cho, Changwon-si (KR); Yang Hwan No, Changwon-si (KR); Jung Hoon Kang, Changwon-si (KR); Jong Min Kim, Changwon-si (KR); Ho Sung Jang, Kyungsangnam-do (KR); Dong Hoon Kang, Pusan (KR)

(73) Assignee: LG Electronics Inc., Seoul (KR)

( * ) Notice: Subject to any disclaimer, the term of this patent is extended or adjusted under 35 U.S.C. 154(b) by 256 days.

(21) Appl. No.: 11/104,450

(22) Filed: Apr. 13, 2005

(65) Prior Publication Data

US 2005/0235704 A1 Oct. 27, 2005

(30) Foreign Application Priority Data

Apr. 14, 2004 (KR) ..... 10-2004-0025968

(51) Int. Cl.
*D06F 39/08* (2006.01)

(52) U.S. Cl. ..... 68/17 R; 68/207

(58) Field of Classification Search ..... 134/93; 68/17 R, 207

See application file for complete search history.

(56) References Cited

U.S. PATENT DOCUMENTS 3,406,876 A * 10/1968 Steele et al. ..... 222/630
3,479,845 A * 11/1969 Engebretsen ..... 68/17 R
4,700,554 A * 10/1987 Eichman et al. ..... 68/17 R
6,826,933 B2 * 12/2004 Merkle et al. ..... 68/17 R

FOREIGN PATENT DOCUMENTS

| | | | |
|---|---|---|---|
| DE | 31 47 073 A1 | | 6/1983 |
| DE | 32 42 053 | * | 5/1984 |
| DE | 38 03 196 | * | 8/1989 |
| EP | 0 727 520 A2 | | 8/1996 |
| GB | 2 218763 | * | 9/1987 |
| JP | 6-15092 | * | 1/1994 |
| JP | 11-42393 | * | 2/1999 |
| JP | 2000-342894 | * | 12/2000 |

OTHER PUBLICATIONS

European Patent Office 0 597 509 Aug. 1983.*

* cited by examiner

*Primary Examiner*—Frankie L Stinson
(74) *Attorney, Agent, or Firm*—Birch, Stewart, Kolasch & Birch, LLP

(57) ABSTRACT

A detergent container of a washing machine in accordance with the present invention comprises a powdered detergent chamber to store powdered detergent, an outlet to discharge powdered detergent mixed with water in the powdered detergent chamber, a subsidiary detergent chamber to store bleach or fabric softner, a drain passage to guide powdered detergent mixed with water from the powdered detergent chamber to the outlet, and a bypass passage to allow powdered detergent mixed with water to bypass from the powdered detergent chamber to the drain passage. Even though an excessive volume of powdered detergent is placed in the powdered detergent chamber and the drain passage is clogged, powdered detergent mixed with water can be drained from the detergent container through the bypass passage, thus powdered detergent can be supplied to a tub of the washing machine without a hitch.

11 Claims, 6 Drawing Sheets

DETERGENT CONTAINER OF WASHING MACHINE

BACKGROUND OF THE INVENTION

1. Field of the Invention

The present invention relates to a detergent container of a washing machine, more particularly, which is capable of supplying powdered detergent mixed with water to a tub without suspending, by preventing a drain passage of the detergent container from clogging due to powdered detergent stored in the detergent container.

2. Description of the Related Art

A washing machine is to decontaminate dirt on clothes or bedding (hereinafter referred as "laundry") contained in a drum. It cleans laundry through washing, rinsing, dehydrating and drying.

FIG. 1 shows a drum-type washing machine having a detergent container based on the prior art, and FIG. 2 shows the detergent container which stores a large quantity of powdered detergent based on the prior art.

The conventional drum-type washing machine comprises a cabinet 2 which defines an outer appearance of the washing machine, a tub 4 mounted in the cabinet 2, the drum 6 rotatably set in the tub 4 to wash laundry, a plurality of lifters 8 placed in an inner side of the drum 6, which lifts up laundry to fall from predetermined height by gravity, and a motor (not shown) installed in a rear of the tub 4 to generate power (see FIG. 1).

A front cover 10 is mounted on a front of the cabinet 2, and a door 12 is set on the front cover 10.

A top plate 14 is placed on a top of the cabinet 2, and a control panel 11 to manipulate the washing machine is placed between the top plate 14 and the front cover 10. A water supplier 20 and a detergent supply apparatus 30 are installed in a top side of the cabinet 2.

The water supplier 20 includes a plurality of water supply valves 24 to control water supplied through an external hose 22, a plurality of water supply hoses 26 to guide water through the water supply valve 24 to the detergent supply apparatus 30, and a bellows tube 28 to guide water and detergent through the detergent supply apparatus 30 to the inside of the tub 4.

The detergent supply apparatus 30 includes a housing 32 connected to the bellows tube 28, the detergent container 40 inserted into the housing 32, and a dispenser 34 installed in a top of the housing 32 and connected to the water supply hose 26 to supply water to the detergent container 40.

After laundry is loaded in the drum 6 and detergent is accommodated in the detergent container 40, water is supplied by the water supplier 20. Detergent is mixed in water through the detergent supply apparatus 30, and is supplied to the tub 4. As soon as a predetermined quantity of water and detergent is filled in the tub 4, the drum 6 is rotated to wash, rinse and dehydrate.

The conventional detergent container 40 comprises a powdered detergent chamber 42 which stores powdered detergent, a detergent chamber 46 having an outlet 44 to discharge detergent in the powdered detergent chamber 42 together with water, which is open at its rear, and a subsidiary detergent chamber 48 located in a side of the outlet 44 to store agents, e.g. bleach and fabric softner (see FIG. 2).

The subsidiary detergent chamber 48 is parted from a bottom of the detergent chamber 46 by predetermined distance to provide a drain passage 49 of water and detergent between the powdered detergent chamber 42 and the outlet 44.

When water is supplied to the powdered detergent chamber 42 from the dispenser 34, powdered detergent with water passes the drain passage 49, drains to the housing 32 through the outlet 44, and then gets to the tub 4 through the bellow tube 28.

In the conventional detergent container of the washing machine, as illustrated in FIG. 2, when excessive powdered detergent is put in the powdered detergent chamber 42, even though water is supplied, the powdered detergent comes to clog an entrance of the drain passage 49, thus water and detergent cannot drain from the detergent container 40.

As the drain passage 49 gets clogged by detergent and water supply is continued, water mixed with detergent comes to flow over the detergent chamber 42, and flows to the subsidiary detergent chamber 48. Then, water flows backward to the dispenser 34, while a lot of bubbles are arisen.

SUMMARY OF THE INVENTION

Accordingly, it is an object of the present invention to provide a detergent container which is capable of preventing a drain passage of the detergent container from clogging due to detergent, besides smoothly supplying water and detergent to a tub.

A detergent container of a washing machine with an aspect of the present invention to fulfill the foregoing needs comprises a powdered detergent chamber to store powdered detergent, an outlet to drain powdered detergent mixed with water contained in the powdered detergent chamber, a subsidiary detergent chamber to store bleach or fabric softner, a drain passage to guide powdered detergent mixed with water from the powdered detergent chamber to the outlet, and a bypass passage to make powdered detergent mixed with water detoured to the drain passage from the powdered detergent chamber.

The bypass passage is formed between the powdered detergent chamber and the subsidiary detergent chamber by a partition member, installed apart from the subsidiary detergent chamber at a regular interval toward the powdered detergent chamber.

The partition member is provided by a partition plate.

The partition plate is separated from a bottom of the detergent container by predetermined distance, and is vertically set in the detergent container. At least one end of the partition plate is fixed to one end of the detergent container.

A top of the partition plate is placed lower than that of the subsidiary detergent chamber and the detergent container. A bottom of the partition plate is placed lower than that of the subsidiary detergent chamber as well.

The powdered detergent chamber is partitioned into a main detergent storing section and a preliminary detergent storing section. The partition plate is installed in at least one, either between the main detergent storing section and the subsidiary detergent chamber or between the preliminary detergent storing section and the subsidiary detergent chamber.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENT

Figure 1:
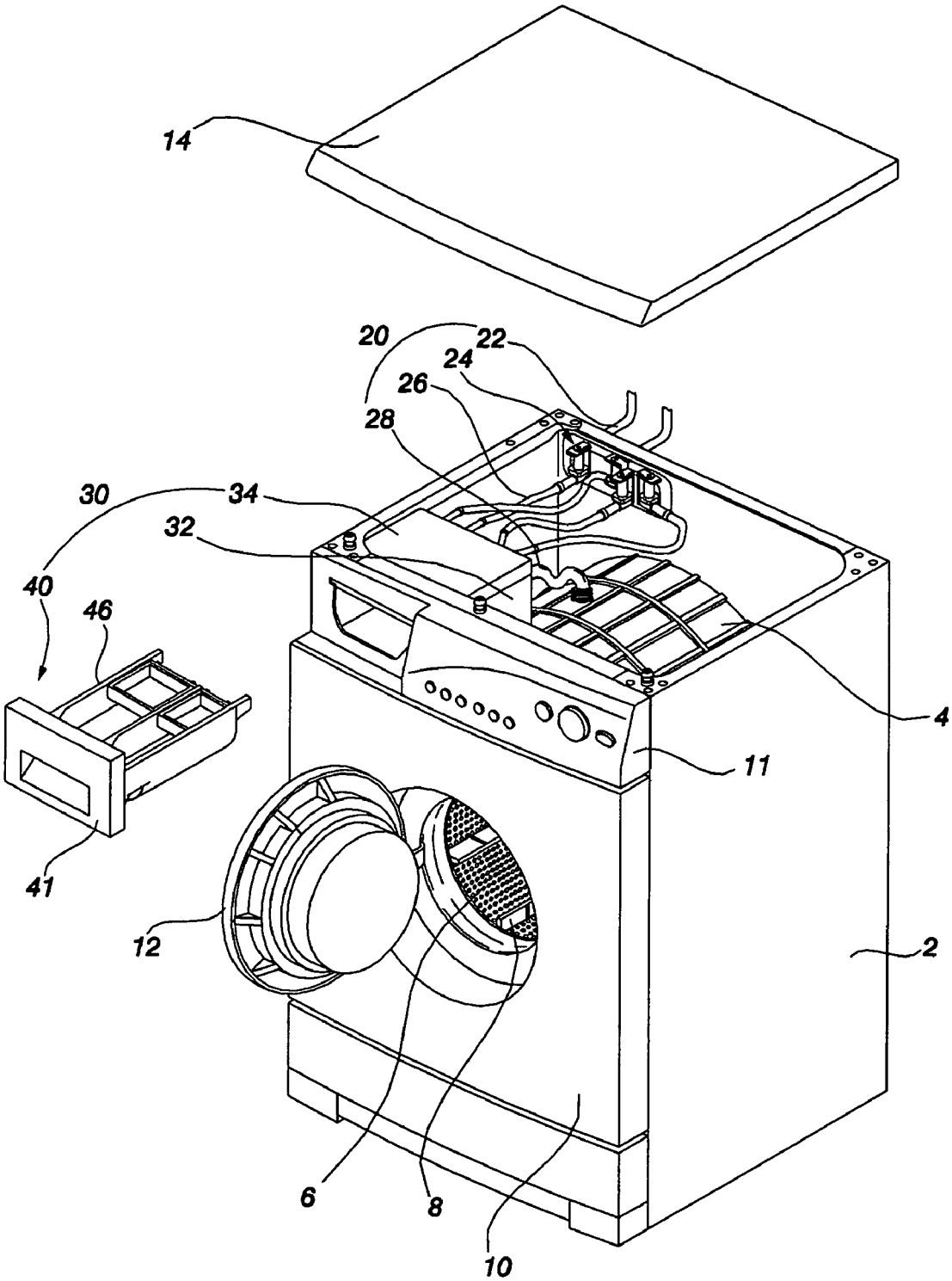
FIG. 1 (Prior Art)
FIG. 1 is an exploded perspective view of a drum-type washing machine having a detergent supply apparatus, according to the prior art.
Figure 2:
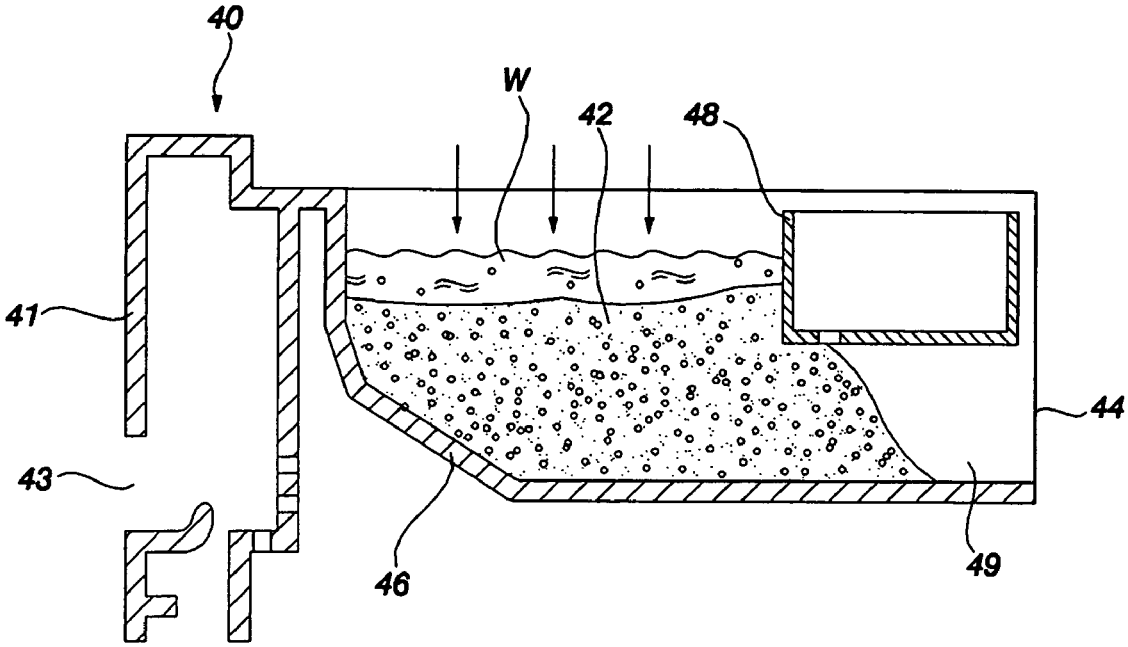
FIG. 2 (Prior Art)
FIG. 2 is a sectional view of a detergent container which stores a large amount of powdered detergent, according to the prior art.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
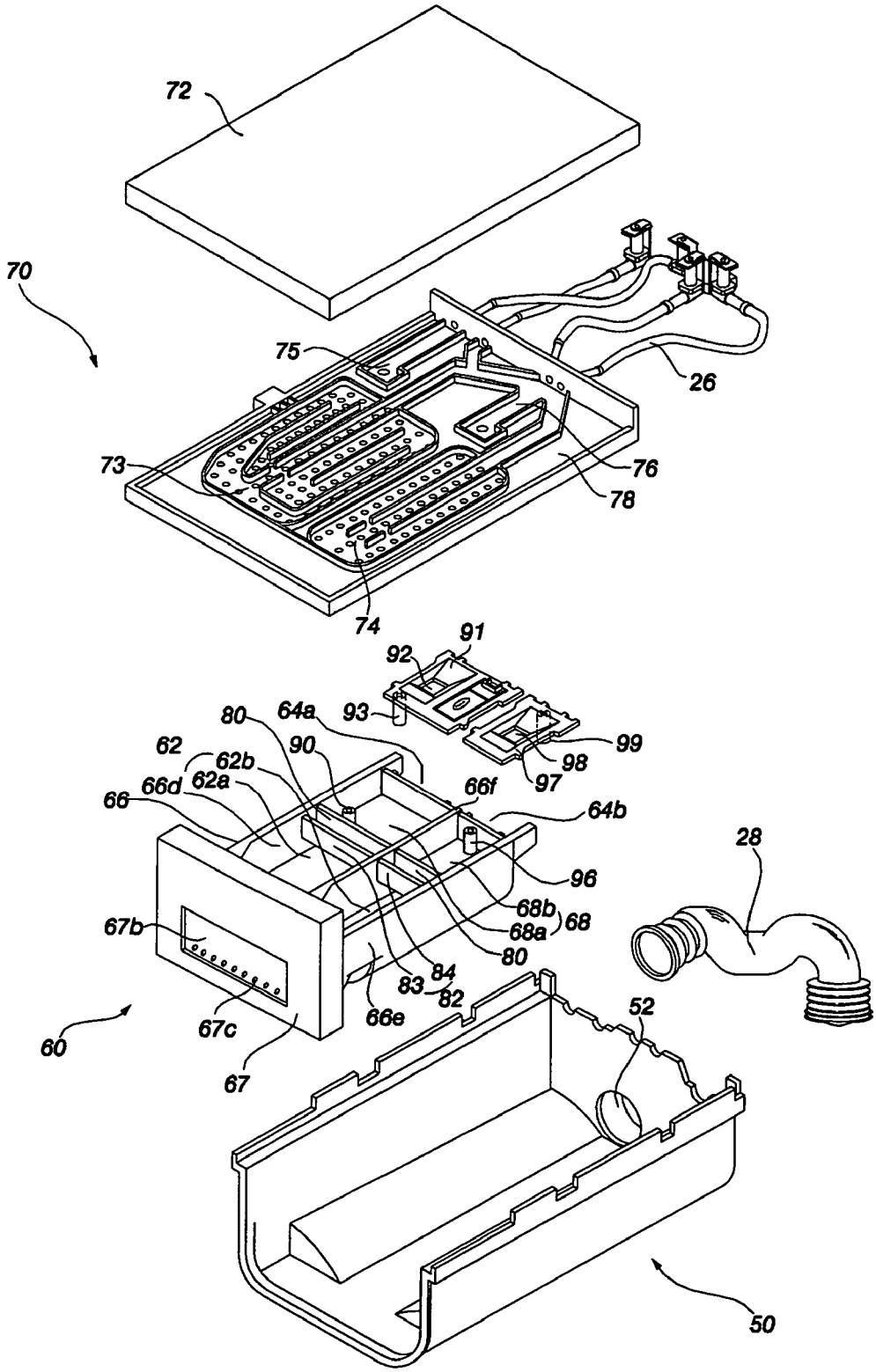
FIG. 3 is an exploded perspective view of the detergent supply apparatus having the detergent container, according to the embodiment of the present invention.
Figure 4:
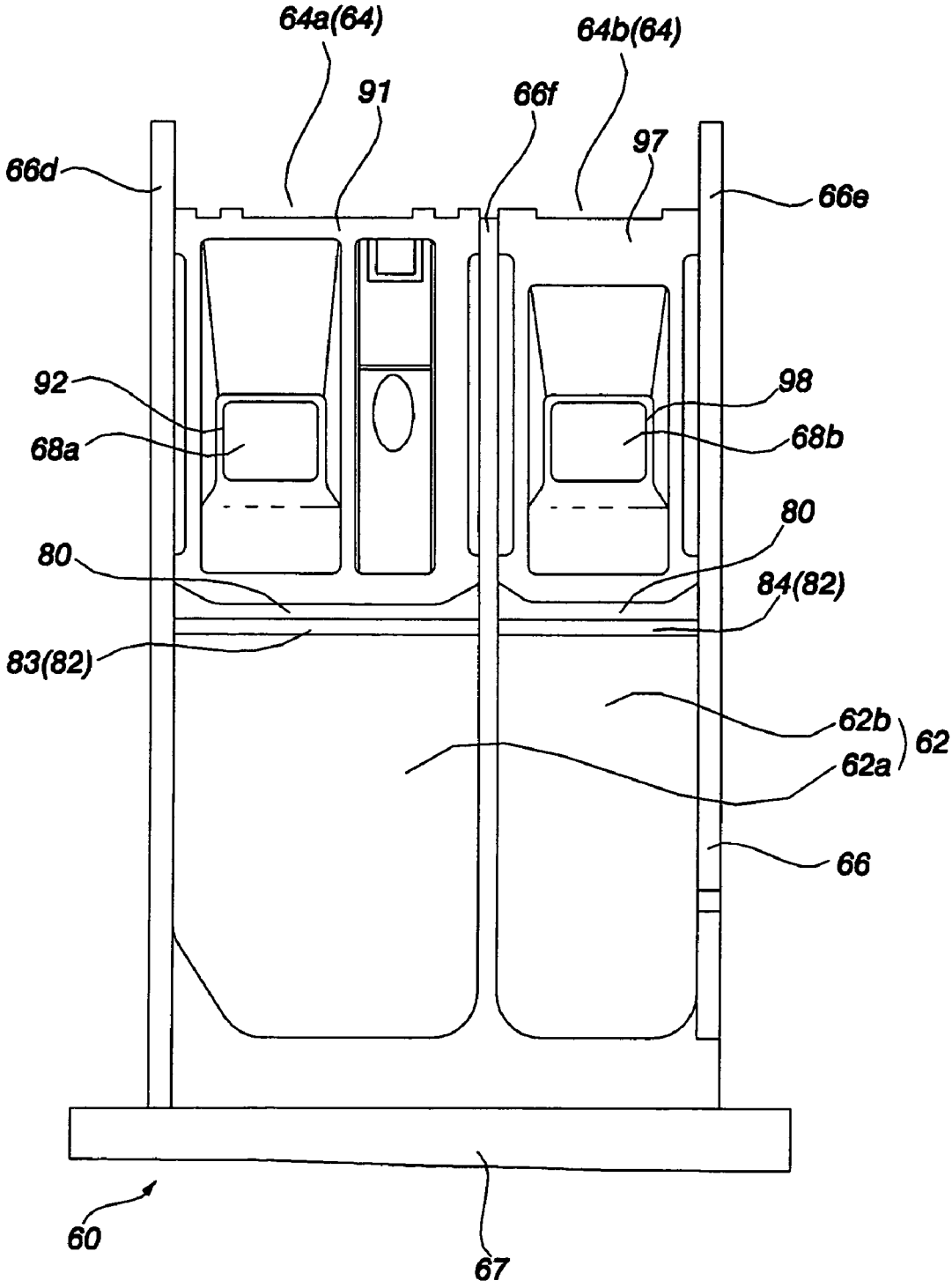
FIG. 4 is a plane view of the detergent container, according to the embodiment of the present invention.

FIG. 3 shows a detergent supply apparatus having a detergent container, according to the embodiment of the present invention. FIG. 4 shows the detergent container, according to the embodiment of the present invention. And, FIGS. 5 and 6 show the detergent container which stores a small/large amount of powdered detergent, according to the embodiment of the present invention.

Figure 5:
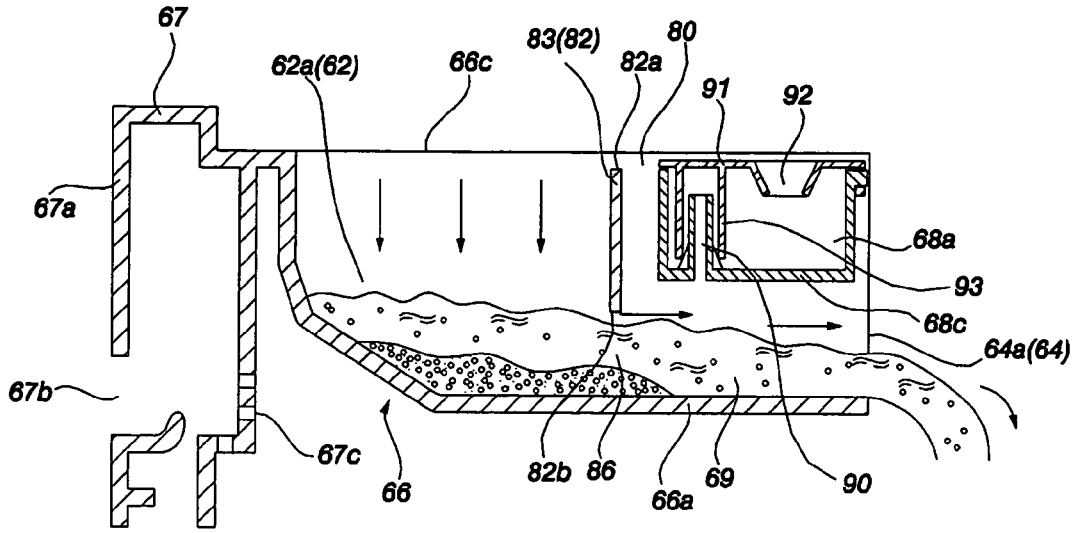
FIG. 5 is a sectional view of the detergent container which stores a small amount of powdered detergent, according to the embodiment of the present invention.
Figure 6:
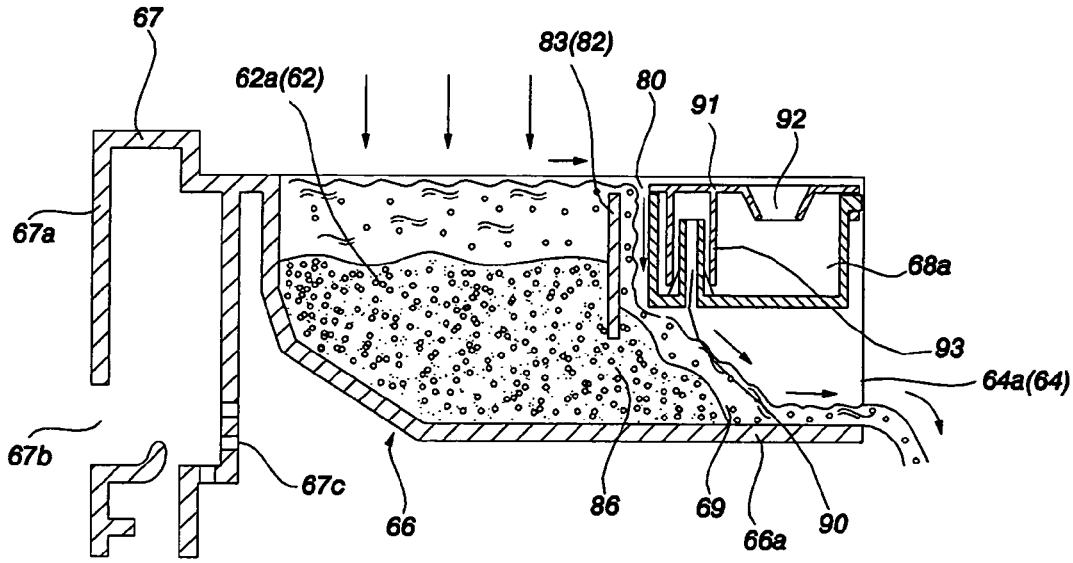
FIG. 6 is a sectional view of the detergent container which stores a large amount of powdered detergent, according to the embodiment of the present invention.
Figure 7:
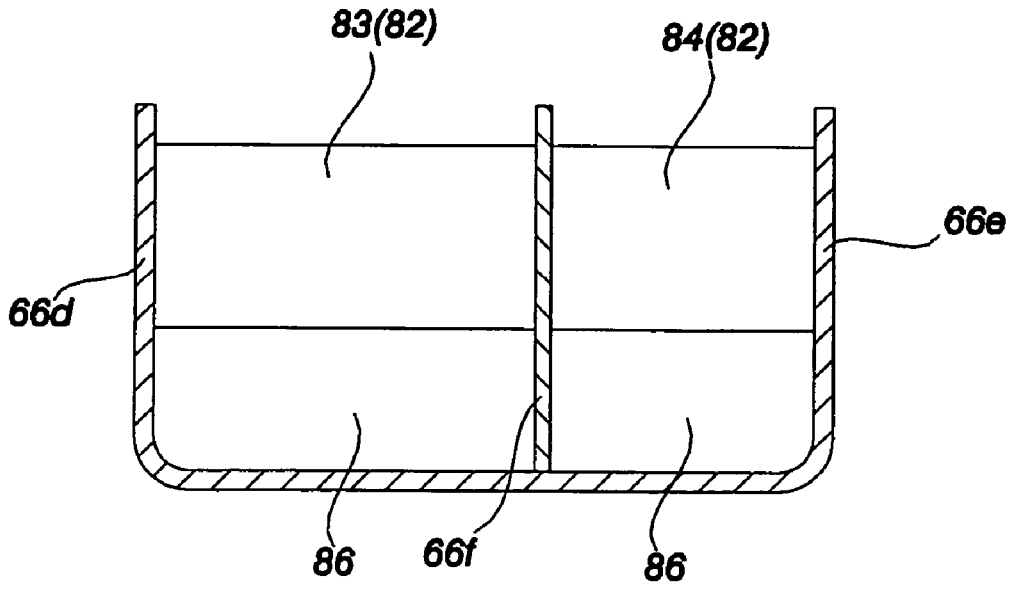
FIG. 7 is a sectional view of the detergent container having a bypass plate, according to the embodiment of the present invention.

As shown in FIG. 3 or 5, the detergent supply apparatus having the detergent container comprises a housing 50 installed in a front of a washing machine and connected to a bellows tube 28, which is open at its front and top, the detergent container 60 inserted into the housing 50, and a dispenser 70 mounted in a top of the housing 50 and connected to a water supply hose 26 to dispense water to the detergent container 60.

An overflow 52 is configured in the housing 50, where water and detergent from the detergent container 60 is discharged to the bellows tube 28.

The detergent container 60 comprises a powdered detergent chamber 62 replenished with powdered detergent, a detergent chamber 66 having an outlet 64 which is open at its rear, a subsidiary detergent chamber 68 located a side of the outlet 64 to store bleach or fabric softner, and spaced apart from a bottom of the detergent chamber 66 to provide a drain passage 69 between the powdered detergent chamber 62 and the outlet 64, and a bypass passage 80 located between the powdered detergent chamber 62 and the subsidiary detergent chamber 68, not to clog the drain passage 69 by powdered detergent.

A front panel 67 having a handle 67*b* is mounted on a front of the detergent chamber 66, which is open at its rear and top. A ventilation hole 67*c* is existed on a bottom of the front panel 67, so as to inflow external air in the housing 50.

A partition wall 66*f* is formed, dividing the powdered detergent chamber 62 to include a main detergent storing section 62*a* and a preliminary detergent storing section 62*b*, which is separated from both sidewalls 66*d*, 66*e* of the detergent chamber 66 by predetermined distance.

The partition wall 66*f* also partitions the outlet 64 into a main detergent outlet 64*a* connected to the main detergent storing section 62*a*, and a preliminary detergent outlet 64*b* connected to the preliminary detergent storing section 62*b*.

The subsidiary detergent chamber 68 is partitioned into a bleach storing section 68*a* in a side of the main detergent outlet 64*a*, and a fabric softner storing section 68*b* in a side of the preliminary detergent outlet 64*b*.

The bleach storing section 68*a* has a siphon 90 protruded and a siphon cover 91 which provides a water drain passage with the siphon 90.

The bleach storing section 68*a* is positioned in a rear and top of the main detergent storing section 62*a*. Its bottom 68*c* is distant from a bottom 66*a* of the main detergent storing section 66*a*, which is open at its top.

The siphon cover 91 is enough to cover a top surface of the bleach storing section 68*a*, a hook for being connected to the bleach storing section 68*a* and a hole 92 for placing bleach are formed therein.

A bottom of the siphon cover 91 has a siphon tube 93 that bleach and water moves upward at an interval with the siphon 90, apart from the siphon 90 by predetermined distance.

The fabric softner storing section 68*b* is situated a side of the bleach storing section 68*a*. The fabric softner storing section 68*b*, like the bleach storing section 68*a*, has a siphon 96 protruded and a siphon cover 97 which provides a water drain passage with the siphon 96.

A bottom of the siphon cover 97 has a siphon tube 99 that fabric softner and water moves upward at an interval with the siphon 96, apart from the siphon 96 by predetermined distance.

The bypass passage 80 is placed between the subsidiary detergent chamber 68 and the powdered detergent chamber 66, and is configured by a partition member vertically set, spaced apart from the subsidiary detergent chamber 68 toward the powdered detergent chamber 62 at a regular interval.

The partition member is provided by a partition plate 82 which includes a $1^{st}$ plate 83 vertically mounted between the main detergent storing section 62*a* and the bleach storing section 68*a*, and a $2^{nd}$ plate 84 vertically mounted between the preliminary detergent storing section 62*b* and the fabric softner storing section 68*b*.

Figure 8:
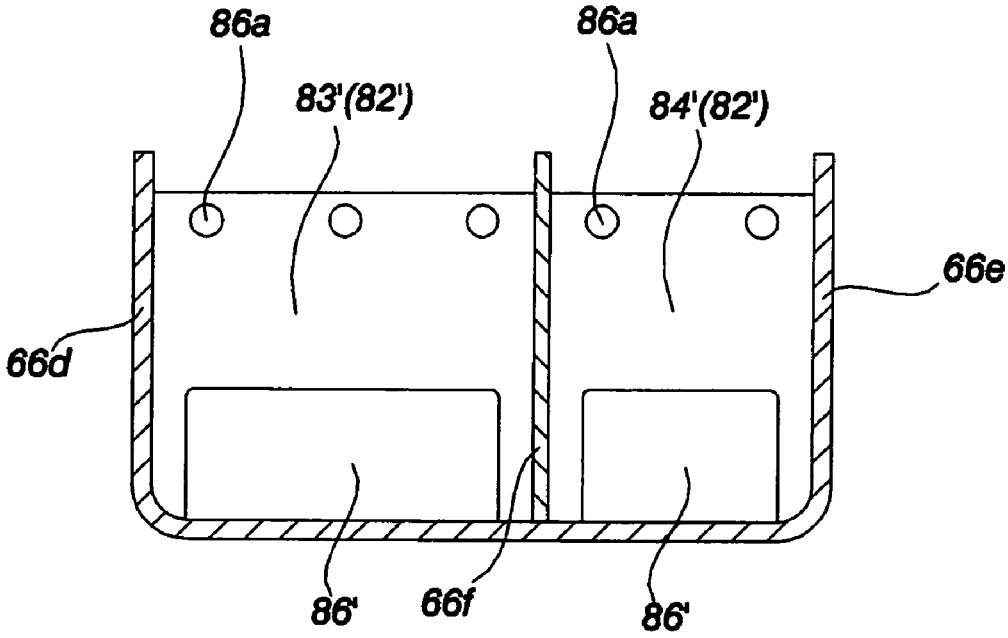
FIG. 8 is a sectional view of the detergent container having the bypass plate, according to another embodiment of the present invention.

A top 82*a* of the partition plate 82 is placed lower than a top 66*c* of the powdered detergent chamber 62 and a top of the subsidiary detergent chamber 68. And, a bottom 82*b* of the partition plate 82 is separated from a bottom 66*a* of the detergent container by predetermined distance, so as to connect the powdered detergent chamber 62 and the drain passage 69. The bottom 82*b* of the partition plate is placed lower than a bottom 68*c* of the subsidiary detergent chamber. It prevents that powdered detergent is excessively discharged through a space 86 between the bottom 82*b* of the partition plate 82 and the bottom 66*a* of the detergent container. A side of the partition plate 82 is fixed to the detergent container by being connected to the sides 66*d*, 66*e* of the detergent container and the partition wall 66*f*, or is configured in a body of the detergent container. The partition plate 82' including the $1^{st}$ plate 83' and the $2^{nd}$ plate 84', as shown in FIG. 8, may have an opening 86' at a lower part of the plate smaller than the drain passage 69, and a plurality of holes 86*a* at an upper part of the plate through which powdered detergent mixed with water flows to the bypass passage.

The dispenser 70 includes a front cover 72 and a bottom cover 78 having a main detergent water supply passage 73, a preliminary detergent water supply passage 74, a bleach water supply passage 75, and a fabric softner water supply passage 76.

A process with respect to the detergent container of the washing machine based on the embodiment of the present invention will be explained below.

Laundry is loaded in the drum 6, powdered detergent is placed in the powdered detergent chamber 62 of the detergent container 60, and washing operation is initiated by feeding water from a water supplier and detergent from the detergent container 60 to a tub 4.

Referring to FIG. 5, when an adequate or a small amount of powdered detergent is received in the powdered detergent chamber 62 of the detergent container 60, water supplied from the water supplier drops into an open top side of the powdered detergent chamber 62 through the dispenser 70. Dropped water is mixed with powdered detergent, and flows in the outlet 64, after passing through the space 86 between the partition plate 82 and the bottom 66*a* of the detergent container and subsequently the drain passage 69, and then discharges to the housing 50.

Water and powdered detergent discharged to the housing 50 is supplied to the tub 4 by flowing in the bellows tube 28 through the overflow 52.

Referring to FIG. 6, when an excessive amount of powdered detergent is received in the powdered detergent chamber 62 of the detergent container 60, water supplied from the water supplier drops into the open top side of the powdered detergent chamber 62 through the dispenser 70. Dropped water mixed with powdered detergent is intended to flow in the drain passage 69 through the space 86.

However, water and powdered detergent cannot pass through the space 86, since the space 86 is clogged by powdered detergent fully filled therein.

As water is continuously supplied through the dispenser 70 to the powdered detergent chamber 62, a water level of the powdered detergent chamber 62 becomes higher. When the water level exceeds height of the partition plate 82, water mixed with powdered detergent falls through the bypass passage 80 beyond the top side 82*a* of the partition plate 82.

Water and powdered detergent fallen through the bypass passage 80 flows in the outlet 64 through the drain passage 69, and discharges to the housing 50. Water and powdered detergent fallen through the bypass passage 80 washes out powdered detergent piled up the bottom side of the partition plate 82, and moves to the outlet 64. Water and powdered detergent is successfully discharged through the space 86, after predetermined time.

Although excessive powdered detergent is accommodated in the powdered detergent chamber 62 of the detergent container 60, the drain passage 69 is not clogged, and water and detergent is supplied to the tub 4 without any trouble.

While the invention has been described in terms of various specific embodiments, those skilled in the art will recognize that the invention can be practiced with modification within the spirit and scope of the claims.

As describe above, the present invention provides a detergent container of a washing machine, even though powdered detergent is oversupplied, which prevents a drain passage from clogging and smoothly supplies water and powdered detergent to a tub at all times, resulting in improving the quality of the washing machine and enhancing the value of the washing machine.

What is claimed is:

1. A detergent container of a washing machine comprising:

a powdered detergent chamber to store powdered detergent;

an outlet to discharge powdered detergent mixed with water supplied to the powdered detergent chamber;

at least one subsidiary detergent chamber to store bleach or fabric softener, a drain passage to guide powdered detergent mixed with water from the powdered detergent chamber to the outlet;

a partition plate installed in front of the subsidiary detergent chamber; and a bypass passage configured between the partition plate and an outside wall of the subsidiary detergent chamber to allow powdered detergent mixed with water to bypass to the drain passage from the powdered detergent chamber, wherein the partition plate has a plurality of holes formed at its upper part to flow the powdered detergent mixed with water from the powdered detergent chamber to the bypass passage, wherein a bottom side of the partition plate has an opening to connect the powdered detergent chamber and the drain passage, and wherein the opening is smaller than the drain passage.

2. The detergent container as set forth in claim 1, wherein the partition plate is installed apart from the subsidiary detergent chamber by a predetermined distance toward the powdered detergent chamber.

3. The detergent container as set forth in claim 1, wherein the partition plate is separated from a bottom of the detergent container by a predetermined distance.

4. The detergent container as set forth in claim 1, wherein the partition plate is vertically set in the detergent container, and at least one of both sides of the partition plate is fixed to one side of the detergent container.

5. The detergent container as set forth in claim 1, wherein a top of the partition plate is placed lower than a top of the subsidiary detergent chamber and a top of the detergent container.

6. The detergent container as set forth in claim 5, wherein a bottom of the partition plate is placed lower than a bottom of the subsidiary detergent chamber.

7. The detergent container as set forth in claim 1, wherein the powdered detergent chamber is partitioned into a main detergent storing section and a preliminary detergent storing section, and the partition plate is mounted in at least one either between the main detergent storing section and the subsidiary detergent chamber or between the preliminary detergent storing section and the subsidiary detergent chamber.

8. The detergent container as set forth in claim 1, wherein the drain passage is configured between a bottom of the detergent container and a bottom of the subsidiary detergent chamber, and the bypass passage is configured between the powdered detergent chamber and the subsidiary detergent chamber, said subsidiary detergent chamber being configured in a rear portion of the powdered detergent chamber.

9. The detergent container as set forth in claim 1, wherein the partition plate includes a first partition plate and a second partition plate.

10. The detergent container as set forth in claim 9, wherein the partition wall is provided between the first partition plate and the second partition plate.

11. A detergent container of a washing machine comprising:

a powdered detergent chamber to store powdered detergent;

a partition wall disposed in the powdered detergent chamber to divide the powdered detergent chamber into a main detergent storing section and a preliminary detergent storing section;

an outlet to discharge powdered detergent mixed with water supplied to the powdered detergent chamber;

at least one subsidiary detergent chamber to store bleach or fabric softener;

a drain passage to guide powdered detergent mixed with water from the powdered detergent chamber to the outlet;

a partition plate installed in front of the subsidiary detergent chamber; and a bypass passage configured between the partition plate and an outside wall of the subsidiary detergent chamber to allow powdered detergent mixed with water to bypass to the drain passage from the powdered detergent chamber, wherein the partition plate has a plurality of holes formed at an upper part thereof to flow the powdered detergent mixed with water from the powdered detergent chamber to the bypass passage, wherein the partition plate comprises a first partition plate disposed between a side wall of the main detergent storing section and the partition wall, and a second partition plate disposed between a side wall of the preliminary detergent storing section and the partition wall, and wherein a bottom side of the first partition plate has an opening of which a width is smaller than a width of the main detergent storing section, and a bottom side of the second partition plate has an opening of which a width is smaller than a width of the preliminary detergent storing section.

* * * * *